US006998768B2

(12) United States Patent
Kim et al.

(10) Patent No.: US 6,998,768 B2
(45) Date of Patent: Feb. 14, 2006

(54) FORMED TYPE FLAT PANEL FOR USE IN A CATHODE RAY TUBE

(75) Inventors: Suck Young Kim, Suwon-si (KR); Kyoung Mun Choo, Suwon-si (KR)

(73) Assignee: Samsung Corning Co., Ltd., (KR)

( * ) Notice: Subject to any disclaimer, the term of this patent is extended or adjusted under 35 U.S.C. 154(b) by 43 days.

(21) Appl. No.: 10/376,685

(22) Filed: Feb. 28, 2003

(65) Prior Publication Data

US 2003/0164669 A1 Sep. 4, 2003

(30) Foreign Application Priority Data

Feb. 28, 2002 (KR) ..... 10-2002-0011017
Feb. 17, 2003 (KR) ..... 10-2003-0009699

(51) Int. Cl.
*H01J 31/00* (2006.01)

(52) U.S. Cl. ..... 313/477 R; 313/461; 313/480; 220/2.1 A

(58) Field of Classification Search ..... 313/477 R, 313/461, 405, 415; 220/2.1 R, 2.1 A, 2.3 A, 220/2.3 R See application file for complete search history.

(56) References Cited

U.S. PATENT DOCUMENTS

| | | | | |
|---|---|---|---|---|
| 5,814,933 | A * | 9/1998 | Iwata et al. | 313/477 R |
| 6,232,712 | B1 * | 5/2001 | Pyun et al. | 313/477 R |
| 6,566,802 | B1 * | 5/2003 | Jeong | 313/477 R |
| 6,628,058 | B1 * | 9/2003 | Park | 313/407 |
| 6,639,345 | B1 * | 10/2003 | Inoue et al. | 313/461 |
| 6,677,702 | B1 * | 1/2004 | Kim et al. | 313/477 R |
| 6,680,567 | B1 * | 1/2004 | Sugawara et al. | 313/477 R |

* cited by examiner

*Primary Examiner*—Karabi Guharay
*Assistant Examiner*—Sikha Roy
(74) *Attorney, Agent, or Firm*—Anderson Kill & Olick, PC

(57) ABSTRACT

The present invention provides a formed type flat panel made of tinted glass, which is capable of satisfying the UL standard for implosion resistance thereof. The formed type flat panel of the present invention includes a substantially rectangular faceplate having an substantially flat external surface and a curved inner surface; a skirt portion extending backward from a periphery of the faceplate; a corner portion joining the faceplate and the skirt portion. The faceplate has a specially tailored thickness distribution so at to accomplish aforementioned capability.

4 Claims, 2 Drawing Sheets

FORMED TYPE FLAT PANEL FOR USE IN A CATHODE RAY TUBE

FIELD OF THE INVENTION

The present invention relates to a formed type flat panel for use in a cathode ray tube (CRT); and more particularly, to a tinted formed type flat panel, satisfying the UL (Underwriters Laboratories Inc.) standard for implosion resistance thereof.

BACKGROUND OF THE INVENTION

Nowadays, flat panels have been widely employed in color cathode ray tubes (CRTs) intended for use in television sets, computer monitors or the like, replacing the conventional spherical/parabolic panels, for enhanced visibility and reduction of glare due to reflection of external light.

Referring to FIG. 1, there is shown a schematic cross sectional view of a formed type flat panel for use in CRTs. The formed type flat panel 10 has a faceplate portion 12, a skirt portion 14 extending backwards from a periphery of the faceplate portion 12 and connected to a funnel (not shown), and a corner portion 16 (or blend round portion) integrally joining the periphery portion of the faceplate portion 12 with the skirt portion 14. The faceplate portion 12 is provided with a virtually flat external surface 12*b* and an inner surface 12*a* possessing a curvature considerably greater than that of the external surface 12*b*. And fixed on the skirt portion 14 by stud pins is a formed mask (not shown).

In contrast to the formed type flat panel, a tension type flat panel made of tinted glass uses a tension mask as a shadow mask. The tension type flat panel has a low wedge rate. That is, both external and inner surfaces are virtually flat, thus difference in thickness between a center portion and periphery portion of a faceplate portion thereof is considered negligible.

The formed type flat panel, however, has high wedge rate, and thus there exists a non-uniformity in light transmittance (or absorption) between the periphery portion and the central portion thereof. Consequently, it further leads to non-uniform brightness of image displayed thereon. To overcome such non-uniformity in brightness, intensity of brightness is increased over the entire faceplate portion of the formed type flat panel by making the formed type flat panel with clear glass, and in addition, coating the external surface of the faceplate portion in a manner that the high light absorption takes place in the central portion of the formed type flat panel while low absorption takes place in the periphery portion thereof.

Such a method described above, however, has some drawbacks as follows. First, the additional panel coating process incorporated in a procedure for fabricating the formed type flat panel inevitably raises the manufacturing cost.

Moreover, production of clear glass for clear formed type flat panels required in some applications alternately shares the glass melting furnace used for producing tinted glass gob for tinted formed type flat panels. Accordingly, such sharing process suffers from a tank color conversion loss, which occurs during a transition from one process to another, i.e., switching from a process for making clear glass gob for clear formed type flat panels to a process for making tinted glass gob for tinted tension type flat panels or vice versa. In practice, it takes several days to make such transition resulting in a significant loss of productivity.

Various efforts in making the formed type flat panel with the tinted glass have been attempted. However, the light transmittance of the formed type flat panel made of tinted glass is less than that of the formed type flat panel made of clear glass, accordingly arriving at an approach of making the thickness of the entire faceplate portion thinner than that of the faceplate portion made of clear glass so as to satisfy the tube makers' standard for brightness. While satisfying the brightness standard, such product made of tinted glass being thinner fails to meet the implosion resistance of the formed type flat panel.

SUMMARY OF THE INVENTION

It is, therefore, an object of the present invention to provide a tinted formed type flat panel while satisfying the UL (Underwriters Laboratories Inc.) standard for implosion resistance thereof.

In accordance with a preferred embodiment of the present invention, there is provided a formed type flat panel made of tinted glass, including: a substantially rectangular faceplate including an effective picture plane, an external surface having a radius of curvature of R being equal to or greater than 10,000 mm and a curved inner surface having a radius of curvature $R_1$, $R_1$ being smaller than R; a skirt portion extending backward from a periphery of the faceplate; a corner portion joining the faceplate and the skirt portion; wherein a diagonal length D of the effective picture plane is equal to or greater than 700 mm, or equal to or greater than 550 mm but less than 665 mm, and $$0.03D-5 \leqq T_1 \leqq 0.039D+15/(D^{0.5}-1.5)+2.54$$

$$0.0185D-6.5 \leqq T_2 \leqq 0.0204D$$

$$1.3 \leqq T_1/T_2 \leqq 2.1$$

wherein $T_1$ is a periphery thickness of the faceplate, and $T_2$ is a center thickness of the faceplate.

In accordance with another preferred embodiment of the present invention, there is provided a formed type flat panel made of tinted glass, including: a substantially rectangular faceplate including an effective picture plane, an external surface having a radius of curvature of R being equal to or greater than 10,000 mm and a curved inner surface having a radius of curvature $R_1$, $R_1$ being smaller than R; a skirt portion extending backward from a periphery of the faceplate; a corner portion joining the faceplate and the skirt portion; wherein a diagonal length D of the effective picture plane is equal to or greater than 665 mm but less than 700 mm, and $$0.03D-5 \leqq T_1 \leqq 0.039D+15/(D^{0.5}-1.5)+2.54$$

$$0.0185D-6.5 \leqq T_2 \leqq 0.0204D$$

$$1.3 \leqq T_1/T_2 \leqq 1.97$$

wherein $T_1$ is a periphery thickness of the faceplate, and $T_2$ is a center thickness of the faceplate.

In accordance with still another preferred embodiment of the present invention, there is provided a formed type flat panel made of tinted glass, including: a substantially rectangular faceplate including an effective picture plane, an external surface having a radius of curvature of R being equal to or greater than 10,000 mm and a curved inner surface having a radius of curvature $R_1$, $R_1$ being smaller than R; a skirt portion extending backward from a periphery of the faceplate; a corner portion joining the faceplate and the skirt portion; wherein a diagonal length D of the effective picture plane is equal to or greater than 500 mm but less than 550 mm, and $$0.03D-((0.003D)^2-2.54)-5 \leqq T_1 \leqq 0.07D-((0.004D)^4-2.54)+1.2$$

$$0.031D-(0.004D)^2 \leqq T_2 \leqq 0.056D-(0.007D)^2-0.254$$

$$1.3 \leqq T_1/T_2 \leqq 2.1$$

wherein $T_1$ is a periphery thickness of the faceplate, and $T_2$ is a center thickness of the faceplate.

In accordance with still another preferred embodiment of the present invention, there is provided a formed type flat panel made of tinted glass, including: a substantially rectangular faceplate including an effective picture plane, an external surface having a radius of curvature of R being equal to or greater than 10,000 mm and a curved inner surface having a radius of curvature $R_1$, $R_1$ being smaller than R; a skirt portion extending backward from a periphery of the faceplate; a corner portion joining the faceplate and the skirt portion; wherein a diagonal length D of the effective picture plane is less than 500 mm, and $$0.035D-((0.003D)^2-2.54)-5 \leqq T_1 \leqq 0.07D-((0.004D)^4-2.54)$$

$$0.031D-(0.004D)^2-3.5 \leqq T_2 \leqq 0.056D-(0.007D)^2+1.5$$

$$1.3 \leqq T_1/T_2 \leqq 2.1$$

wherein $T_1$ is a periphery thickness of the faceplate, and $T_2$ is a center thickness of the faceplate.

BRIEF DESCRIPTION OF THE DRAWINGS

The above and other objects and features of the present invention will become apparent from the following description of preferred embodiments given in conjunction with the accompanying drawings, in which.

DETAILED DESCRIPTION OF THE PREFERRED EMBODIMENTS

A formed type flat panel 20 in accordance with a preferred embodiment of the present invention will now be described with reference to the accompanying drawings.

Figure 2:
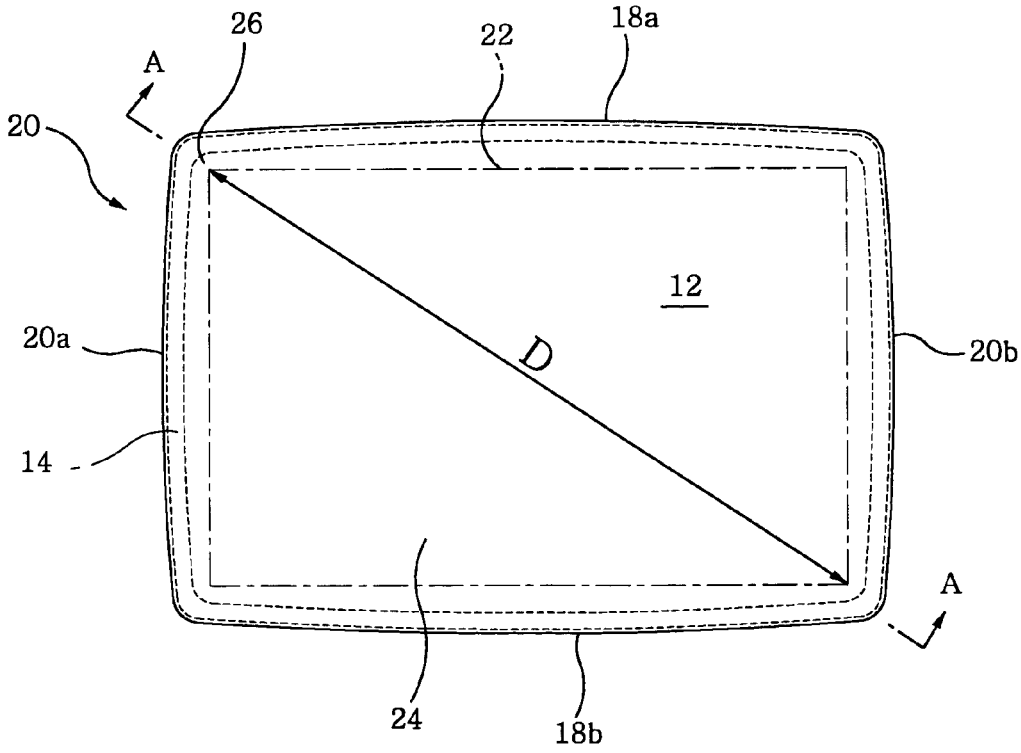
FIG. 2 presents a schematic top view of the formed type flat panel 20 in accordance with the preferred embodiment of the present invention.

Referring to FIG. 2, there is schematically illustrated a top view of the formed type flat panel 20 in accordance with the preferred embodiment of the present invention. As shown in FIG. 2, the contour of the formed type flat panel 20 is of an approximate rectangular shape having a pair of nearly parallel long sides 18*a*, 18*b* and a pair of substantially parallel short sides 20*a*, 20*b*. And the formed type flat panel 20 includes a faceplate 12, which has a central portion 24 serving as an effective picture plane 22, a periphery portion 26 around the effective picture plane 22, an external surface 12*b* (shown in FIG. 3) having a radius of curvature R and a curved inner surface 12*a* (shown in FIG. 3) having a radius of curvature $R_1$, wherein R is considerably greater than $R_1$, so that the external surface 12*b* is substantially flat. And the diagonal length of the effective picture plane 22 is designated as D.

Figure 1:
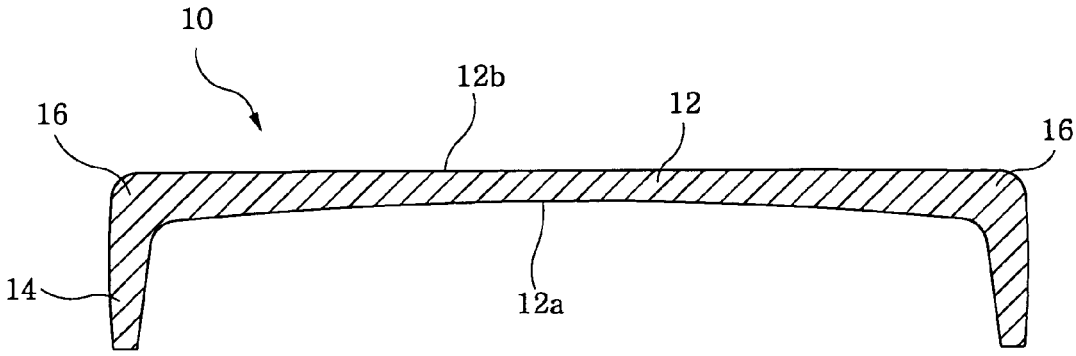
FIG. 1 (PRIOR ART)
FIG. 1 illustrates a schematic cross sectional view of a formed type flat panel for use in CRTs.
Figure 3:
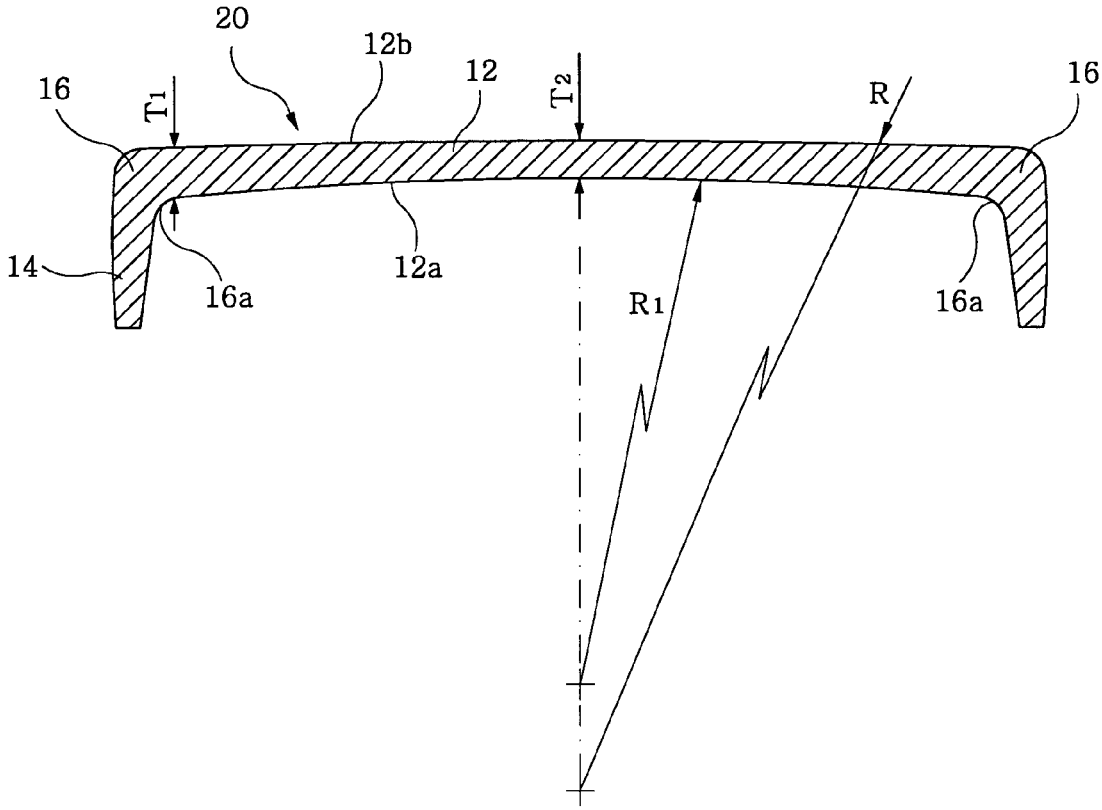
FIG. 3 depicts a cross sectional view taken along the line A—A in FIG. 2.

Referring to FIG. 3, there is schematically described a cross sectional view taken along the line A—A in FIG. 2. The parts corresponding to those of the formed type flat panel 10 shown in FIG. 1 will be designated with the like reference numerals, and description thereof will be omitted for simplicity. As shown in FIG. 3, an inner surface 16*a* of the corner portion 16 forms an arc having a point of tangency with the inner surface 12*a* of the faceplate 12.

The thickness of the faceplate 12 at the point of tangency is referred to as a faceplate periphery thickness $T_1$. In other words, $T_1$ is a thickness of the faceplate 12 at the point where the inner surface 12*a* having the radius of curvature $R_1$ meets the inner surface 16*a* having a radius of curvature $R_2$. The center of the faceplate 12 is a point where an extended axis of a neck (not shown) meets the faceplate 12 and also a point where two diagonals of the effective picture plane 22 intersect. The thickness at the center of the faceplate 12 is referred to as a faceplate center thickness $T_2$.

A tinted glass for use in fabricating a tinted formed type flat panel in accordance with the present invention yields a light transmittance of about 52.5±5% when having a thickness of 11.43 mm.

In accordance with the present invention, a formed type flat panel can be made of the tinted glass while satisfying tube makers' standard for brightness uniformity (BU) and the UL standards for implosion resistance, in case dimensions, i.e., the periphery thickness $T_1$ and the center thickness $T_2$, of the formed type flat panel 20 are tailored as a function of the diagonal length D and the radius of curvature R.

That is, in order to fabricate a formed type flat panel formed of tinted glass, where the diagonal length D is equal to or greater than 700 mm and the radius of curvature R of the external surface 12*b* of the faceplate 12 is equal to or greater than 10,000 mm, the periphery thickness $T_1$, the center thickness $T_2$ and the wedge rate ($T_1/T_2$) need to satisfy the following Eqs. 1–3:

$$0.03D-5 \leqq T_1 \leqq 0.039D+15/(D^{0.5}-1.5)+2.54 \quad \text{Eq. 1}$$

$$0.0185D-6.5 \leqq T_2 \leqq 0.0204D \quad \text{Eq. 2}$$

$$1.3 \leqq T_1/T_2 \leqq 2.1 \quad \text{Eq. 3}$$

EXAMPLE 1

A tinted 32 inch formed type flat panel (made of tinted glass) (panel 1), which satisfies Eqs. 1 to 3, was made and tested under the UL impact test (or UL standard for implosion resistance). The results are listed in Tables 1 and 2. In addition, the tables further include results for comparative formed type flat panels (panels C1 to C3) made of clear glass.

TABLE 1

| PANEL | Panel Size (Inch) | R (mm) | Dimension (mm) D | $T_1$ | $T_2$ | $T_1/T_2$ |
|---|---|---|---|---|---|---|
| panel 1 | 32 | 50,000 | 760 | 23.25 | 13.00 | 1.79 |
| panel C1 | 32 | 100,000 | 760 | 31.69 | 13.00 | 2.44 |
| panel C2 | 32 | 100,000 | 760 | 32.69 | 14.00 | 2.34 |
| panel C3 | 32 | 50,000 | 760 | 30.47 | 12.50 | 2.44 |

TABLE 2

| | $T_1$ Range (mm) | | $T_2$ Range (mm) | | $T_1/T_2$ Range (mm) | | Dimension Test | | | Implosion | BU |
|---|---|---|---|---|---|---|---|---|---|---|---|
| PANEL | Min. | Max. | Min. | Max. | Min. | Max. | $T_1$ | $T_2$ | $T_1/T_2$ | Test | Test |
| panel 1 | 17.80 | 32.76 | 7.56 | 15.50 | 1.30 | 2.10 | ○ | ○ | ○ | ○ | ○ |
| panel C1 | 17.80 | 32.76 | 7.56 | 15.50 | 1.30 | 2.10 | ○ | ○ | X | ○ | X |
| panel C2 | 17.80 | 32.76 | 7.56 | 15.50 | 1.30 | 2.10 | ○ | ○ | X | ○ | X |
| panel C3 | 17.80 | 32.76 | 7.56 | 15.50 | 1.30 | 2.10 | ○ | ○ | X | ○ | X |

As indicated in Tables 1 and 2, the formed type flat panel (panel 1), which satisfies Eqs. 1 to 3, also satisfies both of the UL standard for implosion resistance and the BU standard. However, the comparative formed type flat panels (panels C1 to C3), which do not satisfy at least one of Eqs. 1 to 3, do not satisfy the BU standard.

Further, in order to fabricate a formed type flat panel formed of tinted glass, where the diagonal length D is equal to or greater than 665 mm but less than 700 mm, and the radius of curvature R of the external surface 12*b* of the faceplate 12 is equal to or greater than 10,000 mm, the periphery thickness $T_1$, the center thickness $T_2$ and the wedge rate ($T_1/T_2$) need to satisfy the following Eqs. 4–6:

$$0.03D-5 \leqq T_1 \leqq 0.039D+15/(D^{0.5}-1.5)+2.54 \quad \text{Eq. 4}$$

$$0.0185D-6.5 \leqq T_2 \leqq 0.0204D \quad \text{Eq. 5}$$

$$1.3 \leqq T_1/T_2 \leqq 1.97 \quad \text{Eq. 6}$$

EXAMPLE 2

Two tinted 29 inch formed type flat panels (made of tinted glass) (panels 2 and 3), which satisfy Eqs. 4 to 6 were made and tested under the UL impact test (or UL standard for implosion resistance). The results are listed in Tables 3 and 4. In addition, the tables further include results for comparative formed type flat panels (panels C4 to C6) made of clear glass.

TABLE 3

| | Panel Size | | Dimension (mm) | | | |
|---|---|---|---|---|---|---|
| PANEL | (Inch) | R (mm) | D | $T_1$ | $T_2$ | $T_1/T_2$ |
| panel 2 | 29 | 100,000 | 676 | 23.05 | 12.50 | 1.84 |
| panel 3 | 29 | 50,000 | 676 | 23.74 | 12.50 | 1.90 |
| panel C4 | 29 | 100,000 | 676 | 27.46 | 12.50 | 2.20 |
| panel C5 | 29 | 100,000 | 676 | 29.46 | 14.50 | 2.03 |
| panel C6 | 29 | 32,470 | 678 | 24.93 | 12.50 | 1.99 |

TABLE 4

| | $T_1$ Range (mm) | | $T_2$ Range (mm) | | $T_1/T_2$ Range (mm) | | Dimension Test | | | Implosion | BU |
|---|---|---|---|---|---|---|---|---|---|---|---|
| PANEL | Min. | Max. | Min. | Max. | Min. | Max. | $T_1$ | $T_2$ | $T_1/T_2$ | Test | Test |
| panel 2 | 15.28 | 29.52 | 6.01 | 13.79 | 1.30 | 1.97 | ○ | ○ | ○ | ○ | ○ |
| panel 3 | 15.28 | 29.52 | 6.01 | 13.79 | 1.30 | 1.97 | ○ | ○ | ○ | ○ | ○ |
| panel C4 | 15.28 | 29.52 | 6.01 | 13.79 | 1.30 | 1.97 | ○ | ○ | X | ○ | X |
| panel C5 | 15.28 | 29.52 | 6.01 | 13.79 | 1.30 | 1.97 | ○ | X | X | ○ | X |
| panel C6 | 15.28 | 29.52 | 6.04 | 13.83 | 1.30 | 1.97 | ○ | ○ | X | ○ | X |

As indicated in Tables 3 and 4, the formed type flat panels (panels 2 and 3), which satisfy Eqs. 4 to 6, also satisfy both of the UL standard for implosion resistance and the BU standard. However, the comparative formed type flat panels (panels C4 to C6), which do not satisfy at least one of Eqs. 4 to 6, do not satisfy the BU standard.

Further, in order to fabricate a formed type flat panel formed of tinted glass, where the diagonal length D is equal to or greater than 550 mm but less than 665 mm, and the radius of curvature R of the external surface 12*b* of the faceplate 12 is equal to or greater than 10,000 mm, the periphery thickness $T_1$, the center thickness $T_2$ and the wedge rate ($T_1/T_2$) need to satisfy the following Eqs. 7–9:

$$0.03D-5 \leqq T_1 \leqq 0.039D+15/(D^{0.5}-1.5)+2.54 \quad \text{Eq. 7}$$

$$0.0185D-6.5 \leqq T_2 \leqq 0.0204D \quad \text{Eq. 8}$$

$$1.3 \leqq T_1/T_2 \leqq 2.1 \quad \text{Eq. 9}$$

EXAMPLE 3

Tinted formed type flat panels (made of tinted glass) (panels 4 and 6), which satisfy Eqs. 7 to 9 were made and tested under the UL impact test (or UL standard for implosion resistance). The results are listed in Tables 5 and 6. In addition, the tables further include results for comparative formed type flat panels (panels C7 to C11) made of clear glass.

TABLE 5

| PANEL | Panel Size (Inch) | R (mm) | Dimension (mm) D | $T_1$ | $T_2$ | $T_1/T_2$ |
|---|---|---|---|---|---|---|
| panel 4 | 25 | 30,000 | 590 | 23.66 | 12.00 | 1.97 |
| panel 5 | 25 | 50,000 | 590 | 24.28 | 12.00 | 2.02 |
| panel 6 | 28 | 100,000 | 660 | 22.93 | 12.50 | 1.83 |
| panel C7 | 25 | 30,000 | 590 | 25.16 | 13.50 | 1.86 |
| panel C8 | 25 | 100,000 | 590 | 25.71 | 13.00 | 1.98 |
| panel C9 | 25 | 53,570 | 598.9 | 24.57 | 12.50 | 1.97 |
| panel C10 | 28 | 100,000 | 660 | 28.12 | 13.50 | 2.08 |
| panel C11 | 28 | 100,000 | 660 | 23.93 | 13.50 | 1.77 |

TABLE 6

| PANEL | $T_1$ Range (mm) Min. | $T_1$ Range (mm) Max. | $T_2$ Range (mm) Min. | $T_2$ Range (mm) Max. | $T_1/T_2$ Range (mm) Min. | $T_1/T_2$ Range (mm) Max. | Dimension Test $T_1$ | Dimension Test $T_2$ | Dimension Test $T_1/T_2$ | Implosion Test | BU Test |
|---|---|---|---|---|---|---|---|---|---|---|---|
| panel 4 | 12.70 | 26.21 | 4.42 | 12.04 | 1.30 | 2.10 | ○ | ○ | ○ | ○ | ○ |
| panel 5 | 12.70 | 26.21 | 4.42 | 12.04 | 1.30 | 2.10 | ○ | ○ | ○ | ○ | ○ |
| panel 6 | 14.80 | 28.90 | 5.71 | 13.46 | 1.30 | 2.10 | ○ | ○ | ○ | ○ | ○ |
| panel C7 | 12.70 | 26.21 | 4.42 | 12.04 | 1.30 | 2.10 | ○ | X | ○ | ○ | X |
| panel C8 | 12.70 | 26.21 | 4.42 | 12.04 | 1.30 | 2.10 | ○ | X | ○ | ○ | X |
| panel C9 | 12.97 | 26.55 | 4.58 | 12.22 | 1.30 | 2.10 | ○ | X | ○ | ○ | X |
| panel C10 | 14.80 | 28.90 | 5.71 | 13.46 | 1.30 | 2.10 | ○ | X | ○ | ○ | X |
| panel C11 | 14.80 | 28.90 | 5.71 | 13.46 | 1.30 | 2.10 | ○ | X | ○ | ○ | X |

As indicated in Tables 5 and 6, the formed type flat panels (panels 4 and 6), which satisfy Eqs. 7 to 9, also satisfy both of the UL standard for implosion resistance and the BU standard. However, the comparative formed type flat panels (panels C7 to C11), which do not satisfy at least one of Eqs. 4 to 6, do not satisfy the BU standard.

Further, in order to fabricate a formed type flat panel formed of tinted glass, where the diagonal length D is equal to or greater than 500 mm but less than 550 mm, and the radius of curvature R of the external surface 12*b* of the faceplate 12 is equal to or greater than 10,000 mm, the periphery thickness $T_1$, the center thickness $T_2$ and the wedge rate ($T_1/T_2$) need to satisfy the following Eqs. 10–12:

$$0.035D-((0.003D)^2-2.54)-5 \leqq T_1 \leqq 0.07D-((0.004D)^4-2.54)+1.2 \quad \text{Eq. 10}$$

$$0.031D-(0.004D)^2-5.5 \leqq T_2 \leqq 0.056D-(0.007D)^2-0.254 \quad \text{Eq. 11}$$

$$1.3 \leqq T_1/T_2 \leqq 2.1 \quad \text{Eq. 12}$$

EXAMPLE 4

A tinted 21 inch formed type flat panel (made of tinted glass) (panel 7), which satisfies Eqs. 10 to 12 was made and tested under the UL impact test (or UL standard for implosion resistance). The results are listed in Tables 7 and 8. In addition, the tables further include results for comparative formed type flat panels (panels C12 to C13) made of clear glass.

TABLE 7

| PANEL | Panel Size (Inch) | R (mm) | Dimension (mm) D | $T_1$ | $T_2$ | $T_1/T_2$ |
|---|---|---|---|---|---|---|
| panel 7 | 21 | 50,000 | 508 | 21.08 | 11.00 | 1.92 |
| panel C12 | 21 | 100,000 | 505.3 | 23.32 | 12.00 | 1.94 |
| panel C13 | 21 | 100,000 | 508 | 23.30 | 13.00 | 1.79 |

TABLE 8

| PANEL | $T_1$ Range (mm) Min. | $T_1$ Range (mm) Max. | $T_2$ Range (mm) Min. | $T_2$ Range (mm) Max. | $T_1/T_2$ Range (mm) Min. | $T_1/T_2$ Range (mm) Max. | Dimension Test $T_1$ | Dimension Test $T_2$ | Dimension Test $T_1/T_2$ | Implosion Test | BU Test |
|---|---|---|---|---|---|---|---|---|---|---|---|
| panel 7 | 13.00 | 22.25 | 6.12 | 15.55 | 1.30 | 2.10 | ○ | ○ | ○ | ○ | ○ |
| panel C12 | 12.93 | 22.42 | 6.08 | 15.53 | 1.30 | 2.10 | X | ○ | ○ | ○ | X |
| panel C13 | 13.00 | 22.25 | 6.12 | 15.55 | 1.30 | 2.10 | X | ○ | ○ | ○ | X |

As indicated in Tables 7 and 8, the formed type flat panel (panel 7), which satisfies Eqs. 10 to 12, also satisfies both of the UL standard for implosion resistance and the BU standard. However, the comparative formed type flat panels (panels C12 to C13), which do not satisfy at least one of Eqs. 4 to 6, do not satisfy the BU standard.

Further, in order to fabricate a formed type flat panel formed of tinted glass, where the diagonal length D is less than 500 mm, and the radius of curvature R of the external surface 12*b* of the faceplate 12 is equal to or greater than 10,000 mm, the periphery thickness $T_1$, the center thickness $T_2$ and the wedge rate ($T_1/T_2$) need to satisfy the following Eqs. 13–15:

$$0.035D-((0.003D)^2-2.54)-5 \leqq T_1 \leqq 0.07D-((0.004D)^4-2.54) \quad \text{Eq. 13}$$

$$0.031D-(0.004D)^2-3.5 \leqq T_2 \leqq 0.056D-(0.007D)^2+1.5 \quad \text{Eq. 14}$$

$$1.3 \leqq T_1/T_2 \leqq 2.1 \quad \text{Eq. 15}$$

EXAMPLE 5

Tinted formed type flat panels (made of tinted glass) (panels 8 and 12), which satisfy Eqs. 13 to 15, were made and tested under the UL impact test (or UL standard for implosion resistance). The results are listed in Tables 9 and 10. In addition, the tables further include results for comparative formed type flat panels (panels C14 to C16) made of clear glass.

TABLE 9

| PANEL | Panel Size (Inch) | R (mm) | Dimension (mm) D | $T_1$ | $T_2$ | $T_1/T_2$ |
|---|---|---|---|---|---|---|
| panel 8 | 10 | 57,260 | 203.8 | 15.22 | 8.80 | 1.73 |
| panel 9 | 15 | 50,000 | 355.6 | 17.69 | 10.00 | 1.77 |
| panel 10 | 15 | 50,000 | 355.6 | 17.19 | 9.50 | 1.81 |
| panel 11 | 17 | 57,260 | 406.7 | 20.38 | 11.00 | 1.85 |
| panel 12 | 17 | 57,260 | 406.7 | 21.56 | 10.50 | 2.05 |
| panel C14 | 17 | 57,260 | 406.7 | 23.70 | 11.00 | 2.15 |
| panel C15 | 17 | 57,260 | 406.7 | 23.20 | 10.50 | 2.21 |
| panel C16 | 19 | 57,260 | 457.2 | 25.60 | 11.00 | 2.33 |

TABLE 10

| PANEL | $T_1$ Range (mm) Min. | $T_1$ Range (mm) Max. | $T_2$ Range (mm) Min. | $T_2$ Range (mm) Max. | $T_1/T_2$ Range (mm) Min. | $T_1/T_2$ Range (mm) Max. | Dimension Test $T_1$ | Dimension Test $T_2$ | Dimension Test $T_1/T_2$ | Implosion Test | BU Test |
|---|---|---|---|---|---|---|---|---|---|---|---|
| panel 8 | 5.14 | 17.97 | 2.80 | 11.81 | 1.30 | 2.10 | ○ | ○ | ○ | ○ | ○ |
| panel 9 | 8.85 | 23.34 | 5.50 | 15.22 | 1.30 | 2.10 | ○ | ○ | ○ | ○ | ○ |
| panel 10 | 8.85 | 23.34 | 5.50 | 15.22 | 1.30 | 2.10 | ○ | ○ | ○ | ○ | ○ |
| panel 11 | 10.29 | 24.01 | 6.46 | 16.17 | 1.30 | 2.10 | ○ | ○ | ○ | ○ | ○ |
| panel 12 | 10.29 | 24.01 | 6.46 | 16.17 | 1.30 | 2.10 | ○ | ○ | ○ | ○ | ○ |
| panel C14 | 10.29 | 24.01 | 6.46 | 16.17 | 1.30 | 2.10 | ○ | ○ | X | ○ | X |
| panel C15 | 10.29 | 24.01 | 6.46 | 16.17 | 1.30 | 2.10 | ○ | ○ | X | ○ | X |
| panel C16 | 11.66 | 23.36 | 7.33 | 16.86 | 1.30 | 2.10 | X | ○ | X | ○ | X |

As indicated in Tables 9 and 10, the formed type flat panels (panels 8 to 12), which satisfy Eqs. 13 to 15, also satisfies both of the UL standard for implosion resistance and the BU standard. However, the comparative formed type flat panels (panels C14 to C16), which do not satisfy at least one of Eqs. 13 to 15, do not satisfy the BU standard.

As described above, the tinted formed type flat panel in accordance with the preferred embodiment of the present invention eliminates a need for the coating process required in manufacturing a formed type flat panel made of clear glass and the tank color conversion loss, inevitably lowering the manufacturing costs.

While the invention has been shown and described with respect to the preferred embodiments, it will be understood by those skilled in the art that various changes and modifications may be made without departing from the spirit and scope of the invention as defined in the following claims.

What is claimed is:

1. A formed type flat panel made of tinted glass, comprising:

a substantially rectangular faceplate including an effective picture plane, an external surface having a radius of curvature of R being equal to or greater than 10,000 mm and a curved inner surface having a radius of curvature $R_1$, $R_1$ being smaller than R;

a skirt portion extending backward from a periphery of the faceplate;

a corner portion joining the faceplate and the skirt portion;

wherein a diagonal length D of the effective picture plane is equal to or greater than 665 mm but less than 700 mm, and $$0.03D-5 \leqq T_1 \leqq 0.039D+15/(D^{0.5}-1.5)+2.54$$

$$0.0185D-6.5 \leqq T_2 \leqq 0.0204D$$

$$1.3 \leqq T_1/T_2 \leqq 1.97$$

wherein $T_1$ is a periphery thickness of the faceplate, and $T_2$ is a center thickness of the faceplate.

2. The formed type flat panel of claim 1, wherein the tinted glass has a light transmittance of about 52.5±5% when having a thickness of about 11.43 mm.

3. A formed type flat panel made of tinted glass, comprising:

a substantially rectangular faceplate including an effective picture plane, an external surface having a radius of curvature of R being equal to or greater than 10,000 mm and a curved inner surface having a radius of curvature $R_1$, $R_1$ being smaller than R;

a skirt portion extending backward from a periphery of the faceplate;

a corner portion joining the faceplate and the skirt portion;

wherein a diagonal length D of the effective picture plane is equal to or greater than 500 mm but less than 550 mm, and $$0.03D-((0.003D)^2-2.54)-5 \leqq T_1 \leqq 0.07D-((0.004D)^4-2.54)-1.2$$

$$0.031D-(0.004D)^2 \leqq T2 \leqq 0.056D-(0.007D)^2-0.254$$

$$1.3 \leqq T_1/T_2 \leqq 2.1$$

wherein $T_1$ is a periphery thickness of the faceplate, and $T_2$ is a center thickness of the faceplate.

4. The formed type flat panel of claim 3, wherein the tinted glass has a light transmittance of about 52.5±5% when having a thickness of about 11.43 mm.

* * * * *